US009549616B2

(12) United States Patent
Schilligo et al.

(10) Patent No.: US 9,549,616 B2
(45) Date of Patent: Jan. 24, 2017

(54) ACCESSORY HOLDER

(71) Applicant: Jerry F. Schilligo, Defiance, MO (US)

(72) Inventors: Jerry F. Schilligo, Defiance, MO (US); Susan J. Schilligo, Defiance, MO (US)

( * ) Notice: Subject to any disclaimer, the term of this patent is extended or adjusted under 35 U.S.C. 154(b) by 0 days.

(21) Appl. No.: 14/734,319

(22) Filed: Jun. 9, 2015

(65) Prior Publication Data

US 2016/0360893 A1 Dec. 15, 2016

(51) Int. Cl.

| | |
|---|---|
| ***A47C 7/62*** | (2006.01) |
| ***F16M 13/02*** | (2006.01) |
| ***B65D 1/40*** | (2006.01) |
| ***B65D 25/24*** | (2006.01) |

(52) U.S. Cl.

CPC . *A47C 7/62* (2013.01); *B65D 1/40* (2013.01); *B65D 25/24* (2013.01); *F16M 13/02* (2013.01)

(58) Field of Classification Search

CPC ..... A47C 7/62; B65D 1/40; B65D 25/24; B65D 25/20; F16M 13/02; F16M 13/022

USPC ..... 220/737, 481, 480, 476, 493, 485; 215/395, 399; 248/311.2, 309.1, 318, 317; 446/73

See application file for complete search history.

(56) References Cited

U.S. PATENT DOCUMENTS 451,097 A * 4/1891 Wilkinson ..... A47B 73/00 211/74
2,277,738 A * 3/1942 Wilkinson ..... B01D 27/00 210/249
3,120,308 A * 2/1964 Pierro ..... A47C 7/62 211/74
4,063,701 A * 12/1977 Wray ..... A47C 7/62 248/292.14
4,270,724 A * 6/1981 McMullen ..... F16M 13/02 248/230.4
4,896,858 A * 1/1990 Sokolski ..... B60N 3/106 248/231.81
5,639,052 A * 6/1997 Sauve ..... B60N 3/103 224/926
5,833,194 A * 11/1998 Jones ..... B60N 3/103 224/926
6,227,510 B1 * 5/2001 McMullen, Sr. ..... A47C 7/68 248/230.5
7,798,358 B2 * 9/2010 Butler ..... B65F 1/10 220/345.1
8,573,553 B2 * 11/2013 Stephan ..... B60N 3/102 211/71.01
2012/0322338 A1 * 12/2012 Gilbert ..... A63H 3/50 446/73

* cited by examiner

*Primary Examiner* — Robert J Hicks

(74) *Attorney, Agent, or Firm* — Douglas E. Warren

(57) ABSTRACT

An accessory holder that includes an arcuate holding element having a mounting arm that is operatively attached to mounting foot where the mounting foot can be disposed onto a lawn or beach chair having woven strips of material under which the mounting foot can be inserted to temporarily retain the accessory holder such that the accessory holder can be used for storage of items such as drinks, jewelry, and other loose items while a person is resting upon the lawn or beach chair.

19 Claims, 3 Drawing Sheets

ACCESSORY HOLDER

STATEMENT REGARDING FEDERALLY SPONSORED RESEARCH

Not Applicable.

BACKGROUND

This section provides background information related to the present disclosure which is not necessarily prior art.

1. Field of Technology

The present disclosure relates to a special and unique device that provides a means by which drinks and other items can be stored in a holder that can be mounted to a beach chair or lawn chair that incorporates woven bands as the primary seat and back material for the chair.

2. Background of the Technology

The use of lawn chairs and beach chairs during a period of rest and relaxation is very common. Such chairs provide a way to allow a user to sit or even recline on a device so that the user has a way to rest without the need for complex and expensive furniture that might be easily damaged when used outdoors or in other potentially hostile environments.

Although such lawn and beach chairs give the user a means to rest, such devices do not generally provide the ability to temporarily store products. For example, a person sitting on a beach chair on the beach of an ocean or lake would normally desire to have some form of liquid refreshment available to drink. Alternatively, that person might also want to eat a snack or perhaps store items such as cell phones, jewelry or watches while the person is resting in the lawn or beach chair. Unfortunately, the standard lawn and beach chair does not incorporate any element that would normally be capable of providing a person with a way in which to hold such items.

In cases other than lawn and beach chairs, there have been many devices conceived that can be attached temporarily to a chair or chaise lounge that can hold drinks and other items. The ubiquitous cup holder is often used in such applications and they have become the standard device used when such accessory holders are needed. The cup holder line of devices, however, can only be used on chairs that have arm elements. This is because the cup holder incorporates a hanging element in the general shape of an "L" rotated 90 degrees horizontally such that the hanging element is intended to drape over and partially wrap around the arm of the chair. The widespread use of such cup holder devices suggests the success of cup holders that include hangers that drape over the arm of a chair.

Unfortunately, those types of cup holders cannot be used with the vast majority of lawn and beach chairs. Those types of chairs either have a very flimsy arm element that cannot support the weight being carried in a standard cup holder or in many cases simply do not have any arms at all. When a person is sitting in that types of lawn or beach chair there is an absence of viable means by which the person can store a drink or other type of items such as jewelry or watches.

Additionally, when the standard lawn or beach chair does not have an arm element capable of supporting a standard cup holder, there is usually no arm at all. Instead, all that remains on the outer edges of the seating area of the chair is the edge of a chair frame around which woven strips of various types of flexible materials such as nylon or plastic webbing are wrapped. Thus, there is no known currently viable method by which an accessory holding device can be securely mounted to, and supported by, a standard lawn or beach chair having woven bands of seat material.

It would be desirable to provide a device that can be used as an accessory holder that could be mounted temporarily to a lawn or beach chair having woven bands of material and that would allow the temporary storage of a drink, cell phones, jewelry, or other items while the person is resting in the chair.

BRIEF SUMMARY OF VARIOUS PREFERRED EMBODIMENTS OF THE INVENTION

This section provides a general summary of the disclosure, and is not a comprehensive disclosure of its full scope or all of its features.

In accordance with the various embodiments of the present invention, a new and useful type of Accessory Holder is disclosed herein that provides a device that can be quickly mounted onto a lawn or beach chair that incorporates flexible woven strips of material for the seat portion of the chair.

The invention summarized above comprises the constructions hereinafter described, the scope of the invention being indicated by the subjoined claims. Further areas of applicability will become apparent from the description provided herein. The description and specific examples in this summary are intended for purposes of illustration only and are not intended to limit the scope of the present disclosure.

BRIEF DESCRIPTION OF THE SEVERAL VIEWS OF THE DRAWINGS

In the accompanying drawings in which several of various possible embodiments of the invention are illustrated, corresponding reference characters refer to corresponding parts throughout the several views of the drawings in which.

Corresponding reference numerals indicate corresponding steps or parts throughout the several figures of the drawings.

The drawings described herein are for illustrative purposes only of selected embodiments and not all possible implementations, and are not intended to limit the scope of the present disclosure.

More specifically, although one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE PREFERRED EMBODIMENT OF THE INVENTION

Figure 1:
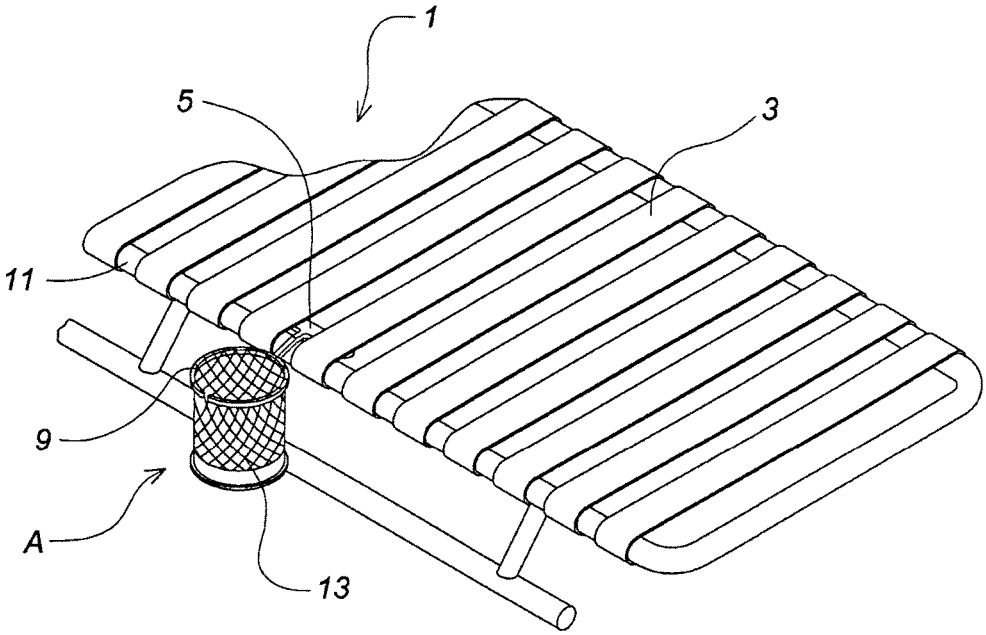
FIG. 1 shows a front perspective view of one embodiment of the present invention when installed onto a common lawn or beach chair.

Referring to the drawings and more particularly by reference character, FIG. 1 discloses a typical folding lawn or beach chair 1 in position for use by a person. Also disclosed is one embodiment of the present invention of an Accessory Holder A after that embodiment has been installed into the woven strips 3 of the chair 1. It is noted that the mounting foot 5 of the Accessory Holder A is disposed within the woven strips 3 of the chair 1 by insertion of the mounting foot beneath two adjacent woven strips. A mounting arm 7 operatively connects the mounting foot 5 to a ring mount 9 such that the mounting arm rests upon a side frame member 11 of the chair 1. In the current embodiment, the longitudinal axis of the mounting arm 7 and the longitudinal axis of the mounting foot 5 are radially aligned with the ring mount 9. In alternative embodiments, there is no radial alignment between the ring mount, the mounting foot 5, and the mounting arm 7.

It is understood that in this embodiment the ring element 11 does not have a mesh retainer 13. It will be appreciated by those of skill in the art, however, that in other embodiments of the present invention, the ring mount can include the mesh retainer 13 as shown in FIG. 1 and in FIG. 3.

Figure 2:
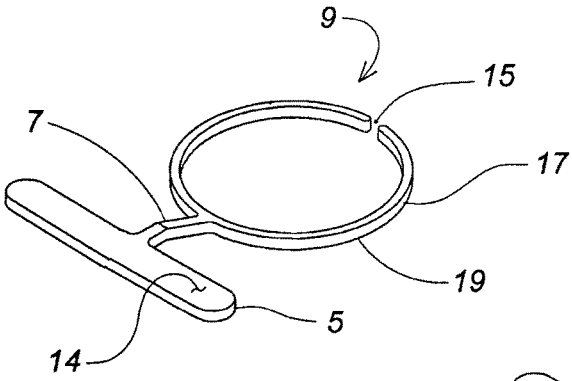
FIG. 2 shows a perspective view of one embodiment of the present invention.

FIG. 2 shows the general shape and design of the Accessory Holder A in one embodiment of that invention. In this embodiment, the Accessory Holder A is a single integral component that includes the mounting foot 5, the mounting arm 7, and the ring mount 9. In this particular embodiment, the ring mount 9 has a gap 15 in the arcuate portion 17 of the ring mount. The gap in this embodiment has a size of between about 3 mm and about 9 mm, and more preferably 6.35 mm. The gap 15 is in general alignment with the longitudinal axis of the mounting arm 7 and the mounting foot 5. In other alternative embodiments, there is no gap 15 in the ring mount 9.

The outside diameter of the ring mount 9 is between about 80 mm and about 120 mm, and more preferably about 102 mm. The ring portion 19 of the ring mount has a radial thickness of between about 10 mm and about 15 mm, and preferably about 12.7 mm.

The mounting foot 5 of the present embodiment is generally obround in shape and has on overall length of between about 100 mm and about 150 mm, and more preferably about 124 mm; an overall width of between about 15 mm and about 25 mm, and more preferably about 19 mm; and a thickness of between about 3 mm and about 6 mm, and more preferably about 4.8 mm. Also, in the present embodiment the mounting arm 7 has on overall width of between about 5 mm and about 10 mm, and more preferably about 6 mm; and a thickness of between about 3 mm and about 6 mm, and more preferably about 4.8 mm. In this embodiment, the axial center of the ring portion 19 is generally located between about 90 mm and about 120 mm, and preferably about 110 mm from a distal longitudinal edge of the mounting foot 5. It is understood that the above dimensions for the ring mount 9, the mounting arm 7 and the mounting foot 5 may be adjusted as needed to fit any specific application or certain alternative embodiments as long as the geometric relationship between the ring mount, the mounting foot, and the mounting arm remain substantially the same.

In the current embodiment, the upper surface 14 of the mounting foot 5 is generally parallel to the upper surface of the ring portion 19 with the understanding that the mounting foot is offset from the ring portion between about 7 mm and about 15 mm, and preferably about 10 mm. In that configuration, it is understood that the mounting arm 7 will have and angular relationship with the upper surface of the mounting foot and the upper surface of the ring portion 19 of between about 10 degrees and about 25 degrees, and preferably about 20 degrees.

The mesh retainer 13 (FIG. 3 and FIG. 8) used in alternative embodiments of the present invention is generally cylindrical in shape and can be made from any material as long as the material is flexible enough for the specific application of the Accessory Holder A and is strong enough to support the weight of the items to be placed into the mesh portion in that application.

Figure 3:
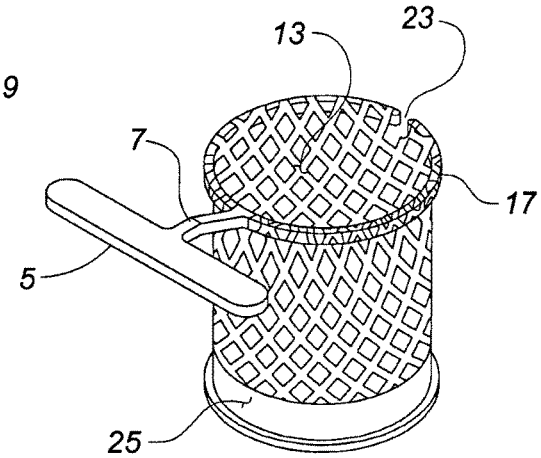
FIG. 3 shows a perspective view of a second embodiment of the present invention that includes a wrapper mounted to the accessory holder.
Figure 4:
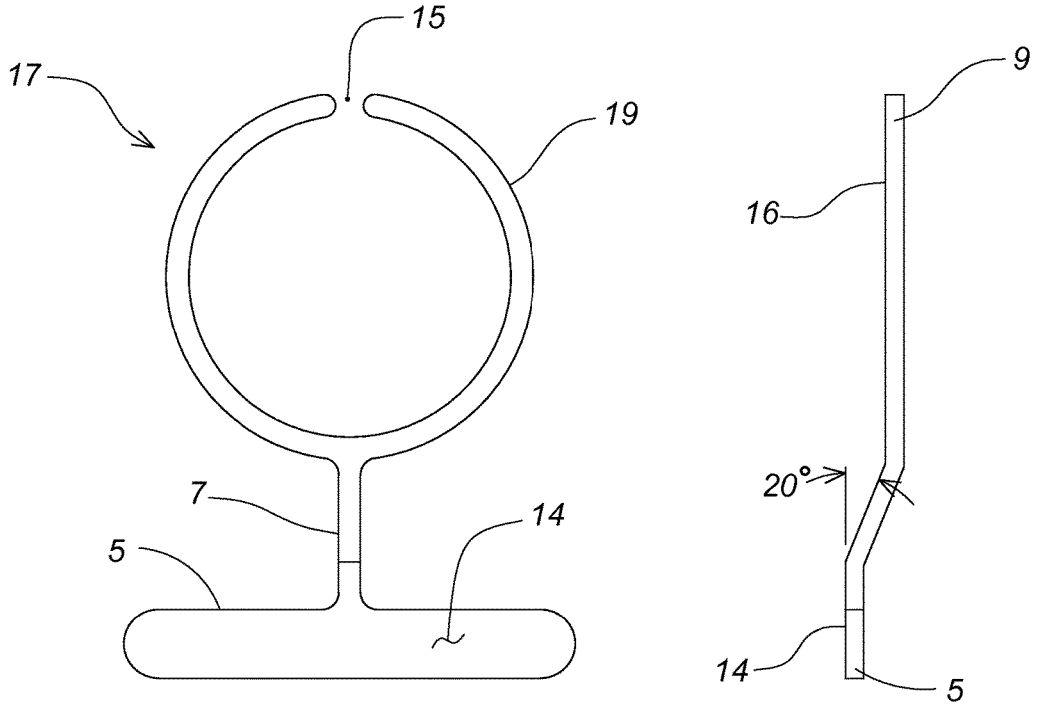
FIG. 4 shows a plan view and a side view of one embodiment of the present invention.
Figure 8:
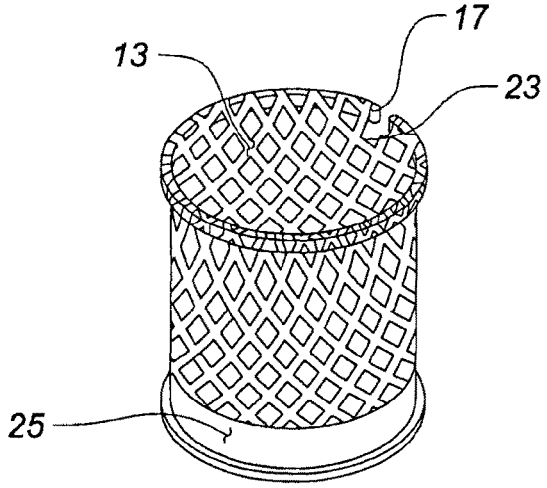
FIG. 8 shows a front perspective view of one embodiment of the wrapping for use with various embodiments of the present invention.

The upper edge of the mesh retainer 13 includes a rod pocket 23 substantially around the circumference of the mesh retainer to allow the mesh portion of the mesh retainer to be installed onto the ring mount 9 (FIG. 2) by feeding the ends of the arcuate portion 17 into and through the length of the rod pocket (FIG. 3 and FIG. 8). It is understood that the rod pocket 23 and the mesh retainer 13 are sized and configured to match the size and shape of the arcuate portion 17 (FIG. 2) of the ring mount 9. In the present embodiment, the mesh retainer 13 (FIG. 3 and FIG. 8) has an overall height of between about 3 inches and about 5 inches, and more preferably about 3.5 inches. The lower portion of the mesh retainer 13 includes a reinforcing collar 25 attached to the mesh retainer to allow the mesh retainer to support the weight of items placed within the ring mount. In the present embodiment, the reinforcement collar 25 is sewn onto the bottom corner of the mesh retainer 13. It is understood that other methods of attaching the reinforcement collar 25 to the mesh retainer 13 may be used as long as the method selected provides the mesh retainer with strength adequate to support the weight of items stored within the mesh retainer when used in specific or alternative applications. The mesh retainer 13 and the reinforcement collar 25 may be made from any material as long as the material is flexible enough and robust enough to withstand the weight of the items to be placed within the mesh container and the environment in which the Accessory Holder A will be used. In the present embodiment the material used in the construction of the mesh retainer is generally either a polyester or nylon cloth material.

Figure 5:
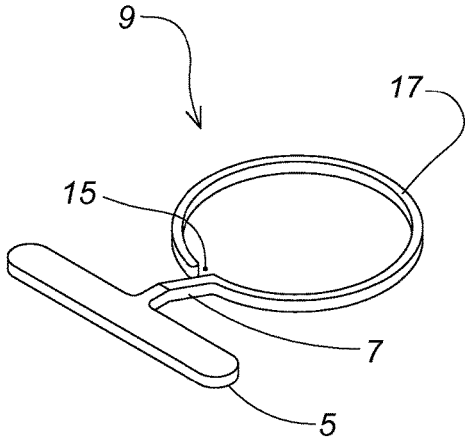
FIG. 5 shows an alternative embodiment of the present invention.
Figure 6:
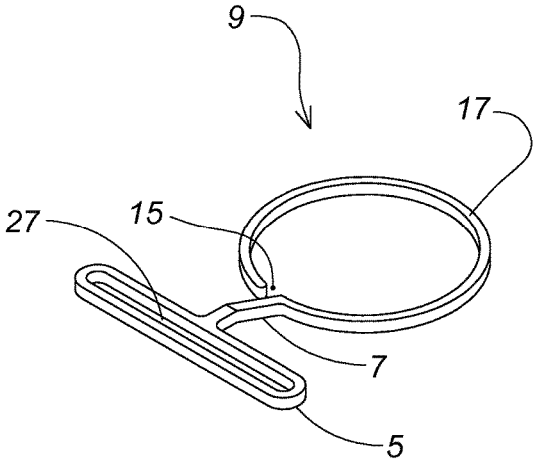
FIG. 6 shows a second alternative embodiment of the present invention.
Figure 7:
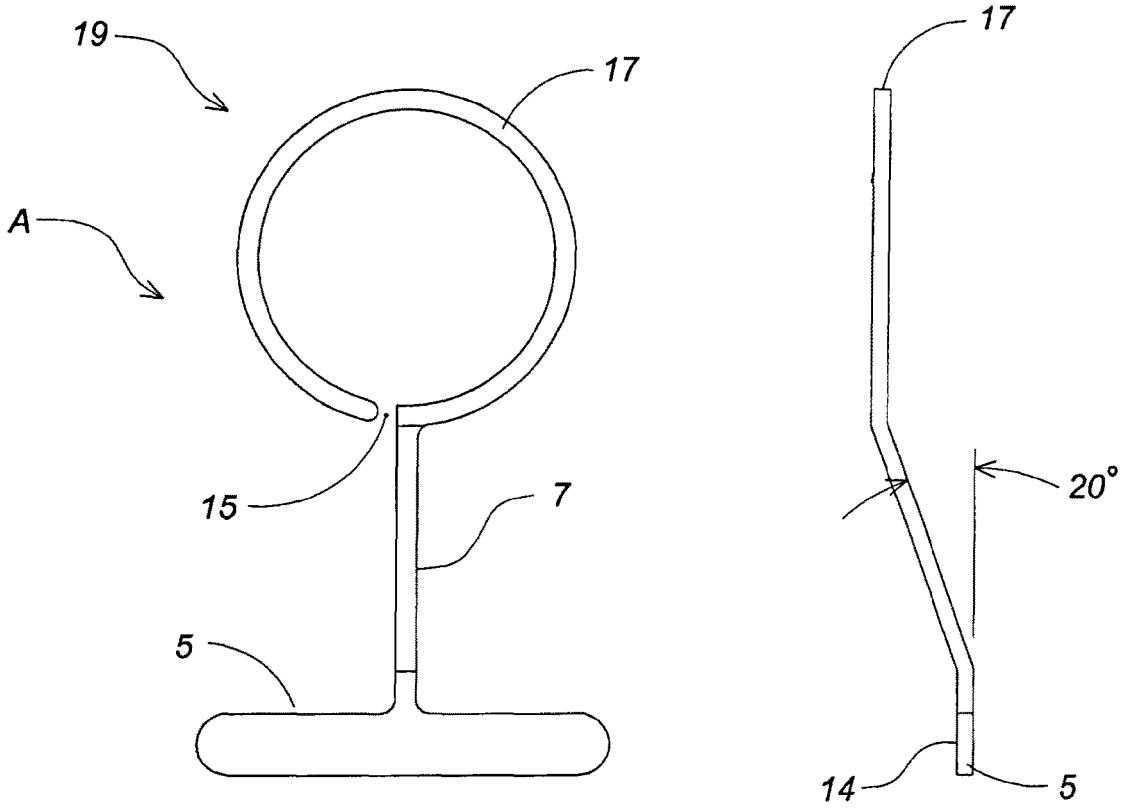
FIG. 7 shows a plan view and a side view of a third embodiment of the present invention.

FIG. 5, FIG. 6, and FIG. 7 show certain alternative embodiments of the resent invention.

More specifically, FIG. 5 shows an embodiment where the gap 15 is not in alignment with the longitudinal axis of the mounting arm 7 or the longitudinal axis of the mounting foot 5.

FIG. 6 discloses another embodiment similar to that shown in FIG. 5 with the exception that the mounting foot 5 includes an interior loop 27 that is longitudinally aligned with the longitudinal axis of the mounting foot. In this embodiment, the axial center of the ring portion 19 is generally located between about 140 mm and about 170 mm, and preferably about 160 mm from a distal longitudinal edge of the mounting foot.

The Accessory Holder A is installed onto a common lawn or beach by chair first deciding where the Accessory Holder will be placed along the side frame member 11 of the chair 1. When that position has been determined, the foot member 5 of the Accessory Holder A is inserted between two adjacent woven strips 3 of the chair 1 until the mounting arm is inserted about half its length between the two woven strips. It is understood that the mounting foot 5 is generally positioned for insertion between the two adjacent woven strips 3 by situating the longitudinal axis of the mounting foot 5 to be generally parallel with the length of the two woven strips before insertion f the mounting foot between the two adjacent woven strips. After the insertion is completed, the Accessory Holder A is then rotated about 90 degrees such that the mounting arm 7 is located over the side frame member 11 of the chair 1 and then the ring mount 9 is lowered until the mounting arm rest upon the chair. It is understood that the when the Accessory Holder A has been installed into the chair 1 that the ring mount 9 will be lower than the mounting foot.

After installation of the Accessory Holder A onto the chair 1, items can be placed within and removed from the Accessory Holder as needed.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill.

Additionally, it will be seen in the above disclosure that the several intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed:

1. An accessory holder comprising:

a mounting foot having a mounting arm disposed substantially perpendicular to the mounting foot wherein the mounting arm is also disposed at a midpoint of the length of the mounting foot and wherein the mounting foot is in the shape of a flat elongate element having a circumferential edge, an upper surface, and radiused ends, wherein the mounting foot is sized and shaped such that the mounting foot fits between and beneath two adjacent straps of a lawn chair having strap elements; and a ring mount to which the mounting arm is radially attached such that a longitudinal axis of the mounting arm and a transverse axis of the mounting foot are radially aligned with the center of the ring mount, and wherein the upper surface of the mounting foot is generally parallel to an upper surface of a ring portion of the ring mount such that mounting foot is offset from the ring portion between about 7 mm and about 15 mm.

2. The accessory holder of claim 1 wherein the mounting foot, the mounting arm, and the ring mount are a single integral component.

3. The accessory holder of claim 1 wherein the ring mount includes an arcuate portion having a gap in the arcuate portion.

4. The accessory holder of claim 3 wherein the gap is in general alignment with the longitudinal axis of the mounting arm and the mounting foot.

5. The accessory mount of claim 3 wherein the gap is not in alignment with the longitudinal axis of the mounting arm or the longitudinal axis of the mounting foot.

6. The accessory holder of claim 4 wherein the gap has a size of between about 3 mm and about 9 mm.

7. The accessory holder of claim 6 wherein the ring mount has an outside diameter of between about 80 mm and about 120 mm.

8. The accessory holder of claim 7 wherein the ring mount has an outside diameter of about 102 mm.

9. The accessory holder of claim 7 wherein the ring portion of the ring mount has a radial thickness of between about 10 mm and about 15 mm.

10. The accessory holder of claim 9 wherein the ring portion of the ring mount has a radial thickness of about 12.7 mm.

11. The accessory holder of claim 9 wherein the mounting foot is generally obround in shape and has an overall length of between about 100 mm and about 150 mm; an overall width of between about 15 mm and about 25 mm, and a thickness of between about 3 mm and about 6 mm.

12. The accessory holder of claim 11 wherein the mounting arm has an overall width of between about 5 mm and about 10 mm and a thickness of between about 3 mm and about 6 mm.

13. The accessory holder of claim 12 wherein the axial center of the ring portion is generally located between about 90 mm and about 120 mm from a distal longitudinal edge of the mounting foot.

14. The accessory holder of claim 13 wherein the mounting arm has angular relationship with the upper surface of the mounting foot and the upper surface of the ring portion of between about 10 degrees and about 25 degrees.

15. The accessory holder of claim 14 further comprising a mesh retainer that is generally cylindrical in shape wherein an upper edge of the mesh retainer includes a rod pocket substantially around the circumference of the mesh retainer to allow a mesh portion of the mesh retainer to be installed onto the ring mount by feeding the ends of the arcuate portion into and through the length of the rod pocket wherein the rod pocket is sized and configured to match the size and shape of the arcuate portion of the ring mount.

16. The accessory holder of claim 15 wherein the mesh retainer has an overall height of between about 3 inches and about 5 inches and wherein a lower portion of the mesh retainer includes a reinforcing collar attached to the mesh retainer wherein the reinforcement collar is sewn onto the mesh retainer.

17. The accessory holder of claim 16 wherein the mounting foot includes an interior loop that is longitudinally aligned with the longitudinal axis of the mounting foot and the axial center of the ring portion is generally located between about 140 mm and about 170 mm from the distal longitudinal edge of the mounting foot.

18. An accessory holder comprising:

a mounting foot having a mounting arm disposed substantially perpendicular to the mounting foot wherein the mounting arm is also disposed at a midpoint of the length of the mounting foot and wherein the mounting foot is in the shape of a flat elongate element having a circumferential edge, an upper surface, and radiused ends, wherein the mounting foot is sized and shaped such that the mounting foot fits between and beneath two adjacent straps of a lawn chair having strap elements;

a ring mount to which the mounting foot is radially attached such that a longitudinal axis of the mounting arm and a longitudinal axis of the mounting foot are radially aligned with the center of the ring mount;

wherein the ring mount includes an arcuate portion having a gap in the ringed shape of the arcuate portion;

wherein the gap is in general alignment with the longitudinal axis of the mounting arm and the mounting foot;

wherein an upper surface of the mounting foot is generally parallel to an upper surface of the ring portion such that mounting foot is offset from the ring portion between about 7 mm and about 15 mm; and wherein the mounting arm has angular relationship with the upper surface of the mounting foot and the upper surface of the ring portion of between about 10 degrees and about 25 degrees.

19. The accessory holder of claim 18, wherein the mounting foot includes an interior loop that is longitudinally aligned with the longitudinal axis of the mounting foot and the axial center of the ring portion is generally located between about 140 mm and about 170 mm from a distal longitudinal edge of the mounting foot; and wherein the gap has a size of between about 3 mm and about 9 mm; wherein the ring mount has an outside diameter of between about 80 mm and about 120 mm;

wherein a ring portion of the ring mount has a radial thickness of between about 12 mm and about 15 mm;

wherein the mounting foot is generally obround in shape and has an overall length of between about 100 mm and about 150 mm; an overall width of between about 15 mm and about 25 mm, and a thickness of between about 3 mm and about 6 mm;

wherein the mounting arm has an overall width of between about 5 mm and about 10 mm and a thickness of between about 3 mm and about 6 mm;

wherein the axial center of the ring portion is generally located between about 90 mm and about 120 mm from the distal longitudinal edge of the mounting foot;

wherein the accessory holder further comprises a mesh retainer that is generally cylindrical in shape;

wherein an upper edge of the mesh retainer includes a rod pocket substantially around the circumference of the mesh retainer to allow a mesh portion of the mesh retainer to be installed onto the ring mount by feeding the ends of the arcuate portion into and through the length of the rod pocket;

wherein the rod pocket is sized and configured to match the size and shape of the arcuate portion of the ring mount;

wherein the mesh retainer has an overall height of between about 3 inches and about 5 inches;

wherein a lower portion of the mesh retainer includes a reinforcing collar attached to the mesh retainer wherein the reinforcement collar is sewn onto the mesh retainer; and wherein the mesh retainer is made from one of either a polyester or nylon cloth material.

* * * * *